US006905870B2

(12) United States Patent
Brown et al.

(10) Patent No.: US 6,905,870 B2
(45) Date of Patent: Jun. 14, 2005

(54) MICROBIAL-INDUCED CONTROLLABLE CRACKING OF NORMAL AND BRANCHED ALKANES IN OILS

(75) Inventors: Fred Brown, The Woodlands, TX (US); Alejandro Maure, Mendoza (AR); Alan Warren, The Woodlands, TX (US)

(73) Assignee: Microbes, Inc., The Woodlands, TX (US)

( * ) Notice: Subject to any disclaimer, the term of this patent is extended or adjusted under 35 U.S.C. 154(b) by 99 days.

(21) Appl. No.: 10/013,749

(22) Filed: Nov. 13, 2001

(65) Prior Publication Data

US 2002/0119557 A1 Aug. 29, 2002

Related U.S. Application Data

(60) Provisional application No. 60/249,926, filed on Nov. 17, 2000.

(51) Int. Cl.[7] ..... C12S 1/00

(52) U.S. Cl. ..... 435/281; 435/262; 166/246

(58) Field of Search ..... 435/262, 281, 435/282, 136, 166; 166/246; 507/201

(56) References Cited

U.S. PATENT DOCUMENTS

| | | | | |
|---|---|---|---|---|
| 2,807,570 A | * | 9/1957 | Updegraff | 166/246 |
| 2,907,389 A | * | 10/1959 | Hitzman | 299/17 |
| 3,332,487 A | * | 7/1967 | Jones | 166/246 |
| 6,069,002 A | | 5/2000 | Powell, Jr. | |
| 6,156,946 A | | 12/2000 | Coyle et al. | |

FOREIGN PATENT DOCUMENTS

| | | |
|---|---|---|
| WO | WO 01/20016 A2 | 3/2001 |
| WO | WO 01/33040 A1 | 5/2001 |
| WO | WO 01/36654 A1 | 5/2001 |

OTHER PUBLICATIONS

Microbes, Inc.—Brochure "Business Resume", "Drillers find lost world of prehistoric microbes", Nov. 1998, pp 1–3.

Microbes, Inc.—Brochure "MMEOR: The Petro–Bioreactor", Nov. 1998, pp 1–5.

Microbes, Inc.—Brochure "The Petro–Bioreactor: Changes to Reservoir Fluids and Environment", Nov. 1998, pp 1–6.

Microbes, Inc.—Brochure "Reservoir Mechanics", Nov. 1998, pp 1–4.

Microbes, Inc.—Brochure "Case Histories", Nov. 1998, pp 1–8.

Microbes, Inc.—Brochure "Economics", Nov. 1998, pp 1–2.

Society of Petroleum Engineers "SPE 23955—Microbes: The Practical and Environmental Safe Solution to Production Problems, Enhanced Production, and Enhanced Oil Recovery", F.G. Brown, Nov. 1992, pp 251–259.

Society of Petroleum Engineers "SPE 24334—meor—Altamont/Bluebell Field Project"m, L.P. Streeb, Nov. 1992, pp 253–261.

Society of Petroleum Engineers "SPE 36746—Microbial EOR Technology Advancement: Case Studies of Successful Projects", F. L. Dietrich, et al., Nov. 1996, pp 1–17.

Society of Petroleum Engineers "SPE 53715—Microbial Enhanced Oil Recovery Pilot Test in Piedras Coloradas Field, Argentina", M.A. Maure, et al., Nov. 1999, 1–28.

Society of Petroleum Engineers "SPE 54380—Systematic Extensive laboratory Studies of Microbial EOR Mechanisms and Microbial EOR Application Results in Changging Oilfield", Dejun Deng, et al., Nov. 1999, pp 1–11.

Society of Petroleum Engineers "SPE 54332—Microbial EOR Laboratory Studies and Application Results in Daging Oilfield", Yijang Zhang, et al., Nov. 1999, pp 1–8.

Microbes, Inc.—Brochure "Bacteria An Industrial Force" and other miscellaneous articles, Nov. 1998, 6 pages.

* cited by examiner

*Primary Examiner*—William H. Beisner
(74) *Attorney, Agent, or Firm*—Jeffrey L. Wendt

(57) ABSTRACT

Processes for treating compositions comprising one or more alkanes (for example crude oils) to enhance volume of the compositions are disclosed. The processes comprise introducing into the composition one or more aerobic microorganisms, thereby forming an intermediate composition, and then introducing one or more anaerobic microorganisms into the intermediate composition to form a second composition, and repeating these steps at least once.

40 Claims, 5 Drawing Sheets

$$\rho_{sc} = \frac{\sum_{i=2}^{23} m_i}{\sum_{i=2}^{23} \frac{m_i}{d_i}} \quad \rho_{sc} = 0.64802 \qquad \rho_{scm} = \frac{\sum_{i=2}^{23} mm_i}{\sum_{i=2}^{23} \frac{mm_i}{d_i}} \quad \rho_{scm} = 0.64802$$

$$D\rho_{sc} = \frac{\rho_{scm} - \rho_{sc}}{\rho_{scm}} = 0.043282 \text{ or } 4.3\ \%$$

FIG. 5

$$_{scm'} = 25$$

$$V_{sc} = \frac{V_{scm} - \rho_{scm}}{\rho_{sc}} = 26.131 \text{ ml}$$

$$DV = V_{sc} - V_{scm} = 1.131 \text{ ml}$$

$$DV\% = \frac{V_{sc} - V_{scm}}{V_{scm}} \times 100 = 4.52\ \%$$

FIG. 6

Wt % Alkanes = 70 % [Treatable portion of oil, saturates]

Wt % Rings = 30 % [Untreatable portion of oil]

$\rho_{sc}$Rings = 0.9500

$$\rho_{sc}\text{BIOMIX} = \frac{\text{Wt \% Alkanes} + \text{Wt\% Rings}}{\frac{\text{Wt \% Alkanes}}{\rho_{scm}} + \frac{\text{Wt\% Rings}}{\rho_{sc}\text{Rings}}} = 0.71633$$

$$\rho_{sc}\text{Control} = \frac{\text{Wt \% Alkanes} + \text{Wt\% Rings}}{\frac{\text{Wt \% Alkanes}}{\rho_{scm}} + \frac{\text{Wt\% Rings}}{\rho_{sc}\text{Rings}}} = 0.74115$$

$$D\rho_{sc} = \frac{\rho_{sc}\text{Control} - \rho_{sc}\text{Biomix}}{\rho_{sc}\text{Control}} = 0.03349 \text{ or } 3.35\ \%$$

$$V_{sc}\text{Biomix} = \frac{V_{scm} - \rho_{sc}\text{Control}}{\rho_{sc}\text{Biomix}} = 25.868 \text{ ml}$$

DV = 0.868

$$DV\% = \frac{V_{sc}\text{Biomix} - V_{scm}}{V_{scm}} \times 100 = \%3.46$$

FIG. 7

MICROBIAL-INDUCED CONTROLLABLE CRACKING OF NORMAL AND BRANCHED ALKANES IN OILS

CROSS-REFERENCE TO RELATED APPLICATIONS

This application is related to copending provisional application Ser. No. 60/249,926, filed Nov. 17, 2000, which is incorporated by reference in its entirety.

BACKGROUND OF THE INVENTION

1. Field of the Invention

This application concerns methods of increasing oil volume production from a given beginning oil source using microbial methods. More specifically, the field of the invention is controllable biotechnological processes conducted on normal and iso-alkane portions of crude oil-water emulsions and/or oil refining cuts by the use of adaptive co-metabolic and symbiotic systems of aerobic/facultative and anaerobic naturally-occurring/genetically engineered, non-pathogenic microorganisms following a repetitive carboxylation-decarboxylation combined (alternating) cycle at surface/subsurface (oxic, oxidant) and/or surface/subsurface (anoxic, reducing) conditions.

2. Related Art

It is known to bio-remediate with microorganisms and in general to enhance oil recovery by injecting microbes into oil bearing formations. One mechanism by which microbes are known to enhance oil recovery (MEOR) includes cracking long chain alkanes into shorter chain alkanes, sometimes referred to as biocracking. Short chain molecules created by biocracking occupy greater volume than long chain molecules. Increased volume has been noted as a benefit associated with the injection of appropriate microbes into oil bearing formations, counteracting any possible loss of mass or carbon atoms to the microbes. The primary benefits of MEOR are principally reducing viscosity, increasing API gravity, reducing cloud point and reducing pour point.

Heretofore, to the inventor's best knowledge, actual increases in crude volume due to biocracking have not been measured in the field or known precisely, nor has microbial biocracking been practiced or optimized to enhance volume. It has not been known whether one could significantly increase the volume of crude oil by microbial treatment, either in a reservoir or upon the surface, and if so, how best, by the injection of microbes, to effect such volume increase.

The instant system and technique has as a first objective specifically enhancing crude volume, since crude oil is sold by volume. The system is tailored to cost effectively increase the volume of oil deliverable to a refinery from a given mass of oil, using biocracking. Reduced viscosity, increased API gravity, reduced cloud point and/or reduced pour point are among other possible benefits of the system.

SUMMARY OF THE INVENTION

To address preliminary matters, "adaptive" as used herein is used to indicate that various strain blends, nutrients and trace-elements, as known in the art, will necessarily need to be tested, adapted and optimized in order to cover the diverse crude types and symbiotic environments throughout the world. Natural or genetically engineered microorganisms may be utilized. It is further noted that biotechnological cracking has been shown to be useful in extreme thermodynamic conditions and high salinity environments.

The instant invention achieves beneficial results from biocracking, and in particular enhanced volume, via a mechanism referred to as Repetitive Alternating Carboxylation-Decarboxylation Cycle (RACDC). The targeted substrates of the invention are normal and branched alkanes. Target intermediate products include crude oil emulsions and refining oil cuts. The invention has possible applications to upstream and downstream processes, including, but not limited to, reservoir, oil transportation, surface storage oil, refining, and the like.

The first or primary objective pursued by the use of the instant controlled biocracking process is to alter the paraffinic/iso-paraffinic compositional profile of target products to improve certain desirable physical and/or chemical parameters or characteristics, such as density, specific volume, viscosity, pour point, cloud point, acid number, IFT, bio-polymer index, and the like.

One aspect of the invention is a method for treating a composition comprising one or more alkanes to enhance volume of the composition, the method comprising the steps of:

(a) introducing into a composition one or more microorganisms selected from the group consisting of aerobic microorganisms, facultative microorganisms, and combinations thereof, thereby forming an intermediate composition;

(b) introducing one or more anaerobic microorganisms into the intermediate composition to form a second composition; and;

(c) repeating steps (a) and (b) at least once.

Preferred are methods wherein step (a) is performed at least three days prior to step (b); methods wherein step (b) includes introducing capsulated anaerobic microorganisms; and methods wherein steps (a) and (b) include introducing an effective amount of microorganisms to biocrack long chain (n)-alkanes by cyclically alternating carboxylation and decarboxylation.

Preferably, the composition is a crude oil, and the amount of the microorganisms added is preferably sufficient to increase the volume at least about 10%, more preferably at least about 15%. Preferred methods include introducing a nutrient base into the composition, preferably in conjunction with step (a). Further preferred are methods that include adding at least one of nitrate, nitrite and molybdenum salt into the composition; methods that include adding a biocatalyst to the composition. Other preferred methods are those wherein at least one of nitrate, nitrite and molybdenum salt is added in a step separate to step (a), and methods wherein a biocatalyst is added in a step separate to step (a). Further preferred are methods wherein an oxygen scavenger is added to the composition, particularly methods wherein adding the oxygen scavenger occurs prior to step (b), and methods wherein the oxygen scavenger addition occurs after step (a).

Preferably, methods of the invention include both introduction of anaerobic microorganisms to the intermediate composition, as well as stimulating indigenous anaerobic microorganisms. Preferably, aerobic and facultative microorganisms are introduced into the composition; as well as a coenzyme selected from the group consisting of the coenzymes known under the trade designations F420 and F430. Preferably, the method includes adding at least one of these coenzymes in conjunction with step (b).

Preferred are methods of the invention including the step of shutting in a well at least one day and then producing the well at least three days between step (a) and step (b), prefrably shutting in the well at least hours and producing the well for over a week subsequent to step (b) and prior to repeating step (a).

The inventive methodology preferably includes the setting up of surface/subsurface facilities and sequencing of microbial product inoculations on target products containing at least a minimal amount of target substrates. The method as described is intended to include the ability to perform the method in a variety of locations, including subsurface reservoirs, surface bioreactors, piping systems, storage facilities, pre-existing facilities and equipment as well as future facility equipment installations. An important inventive aspect comprises the timing and sequencing of events and application of bio-products so as to enhance the volume expansion and oil properties in paraffinic oils.

The invention generally relates to systems and methods for using biocracking to further reduce the bio-converted n-alkanes profile (between $C_1$ and $C_{60+}$) of crude from that postulated and from that measured from field evidence using prior art MEOR. The invention includes alkanes biocracking by alternating carboxylation-decarboxylation cycles, as per the discussion and illustration in FIGS. 1, 2 and 3.

BRIEF DESCRIPTION OF THE DRAWINGS

A better understanding of the present invention can be obtained when the following detailed description of the preferred embodiment is considered in conjunction with the following drawings, in which:

FIG. 5 illustrates a calculatation of the density change before and after biocracking for the postulated data of FIG. 4;

FIG. 6 illustrates the corresponding volumetric expansion, assuming no significant mass loss and constant temperature, for the postulated data of FIG. 4; and FIG. 7 illustrates that practical results for volume expansion and decrease in density will be affected by NSO participation in crude oils having less than 100% of saturates in their composition.

DESCRIPTION OF PREFERRED EMBODIMENTS

Figure 1:
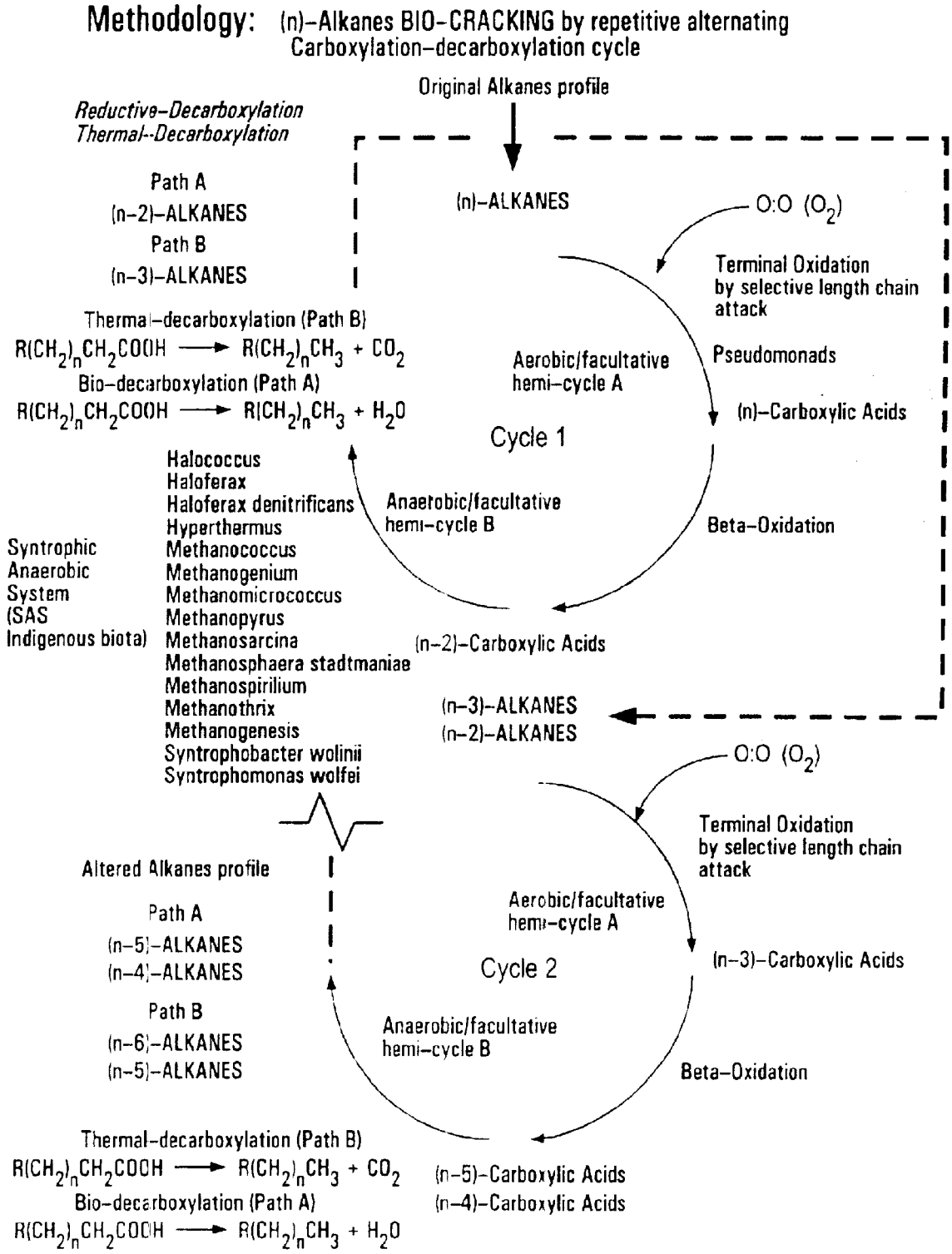
FIG. 1 illustrates two cycles of a preferred embodiment of the instant process, each cycle comprising a Hemicycle A and a Hemicycle B.
Figure 2:
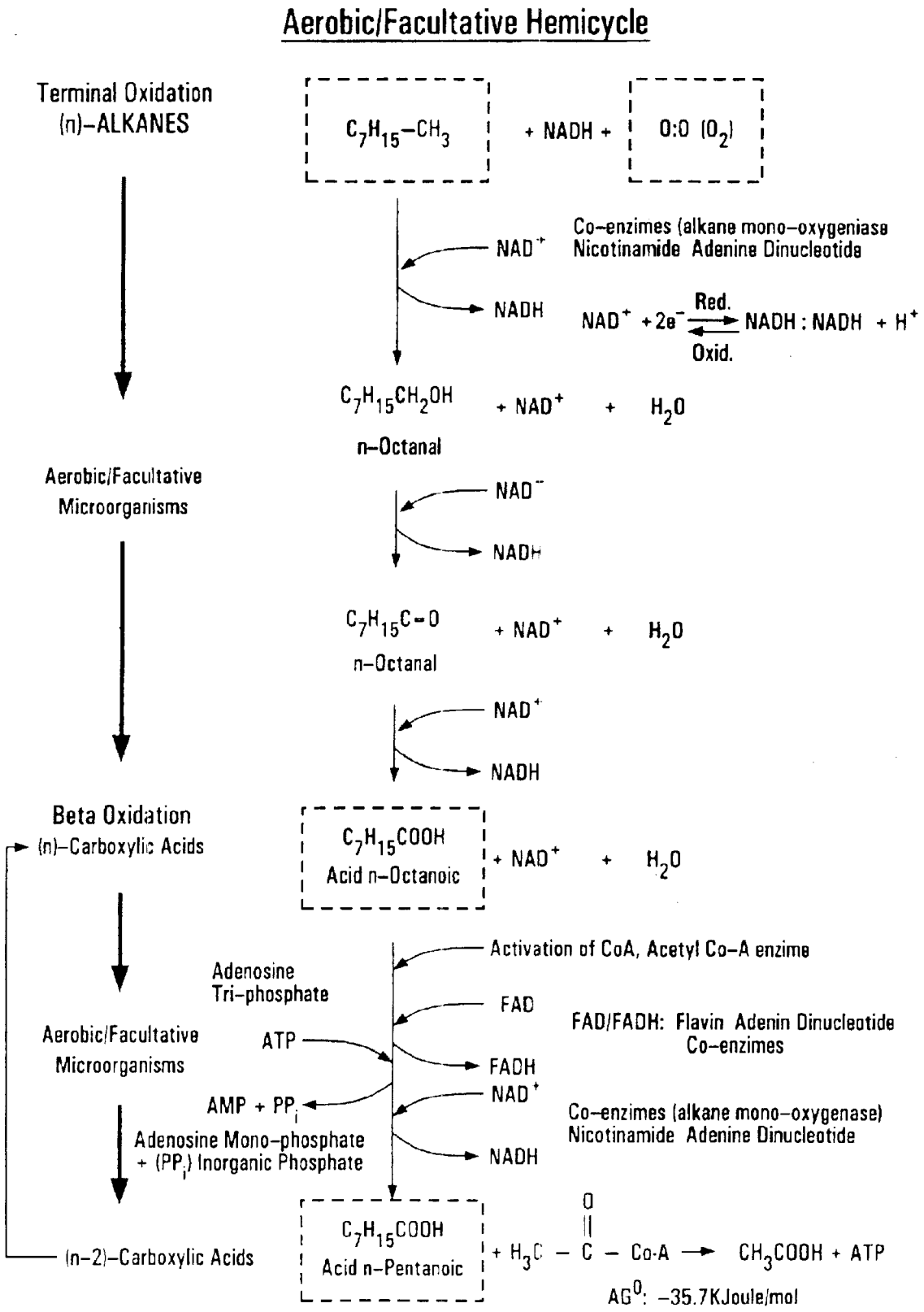
FIG. 2 illustrates a preferred embodiment of an aerobic/facultative hemicycle.
Figure 3:
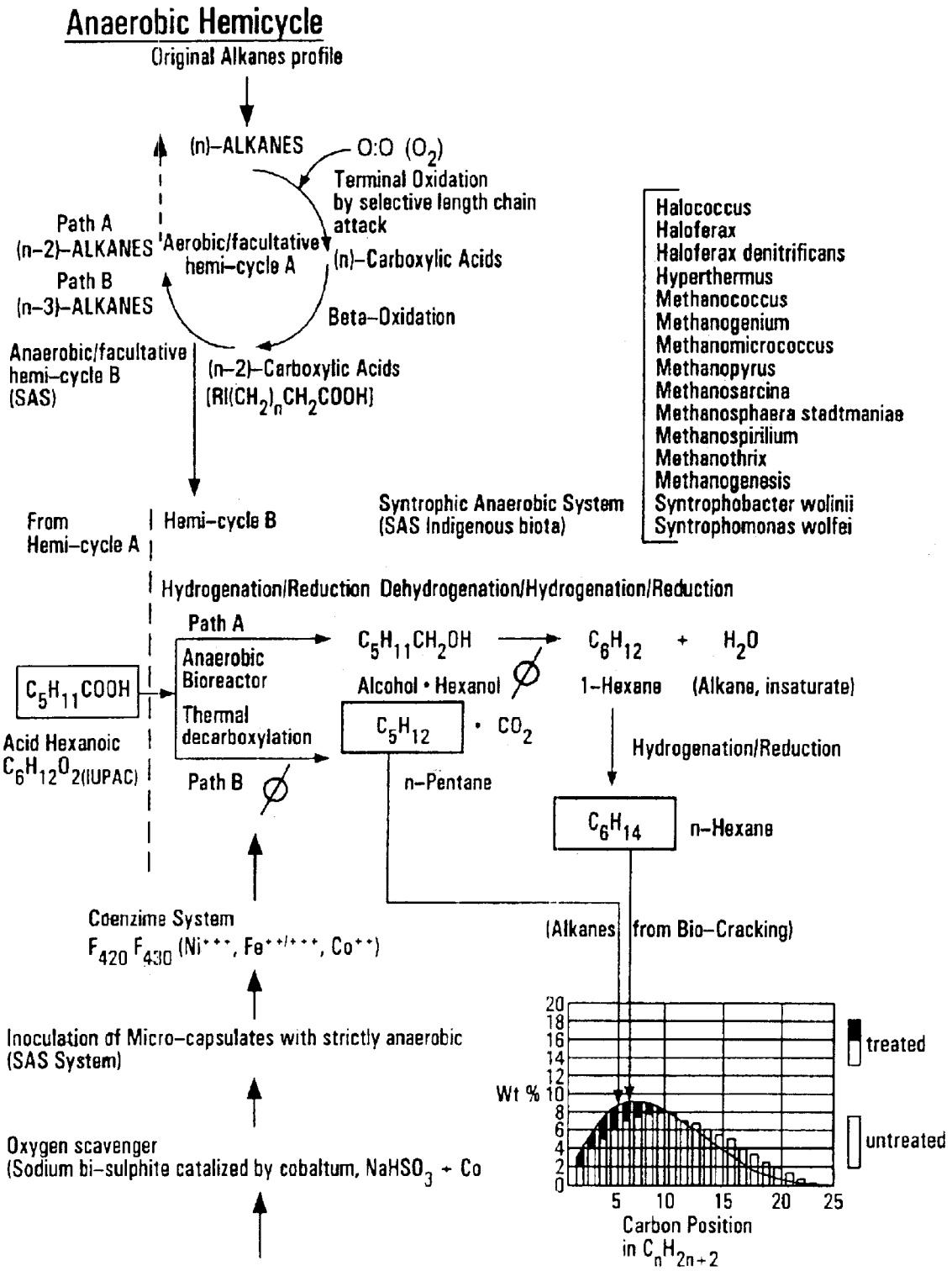
FIG. 3 illustrates a preferred embodiment of an anaerobic hemicycle.

A preferred biocracking process of the invention is illustrated in FIGS. 1, 2 and 3. All processes of the invention are useful for the compositional modification of original n-alkanes and iso-alkanes profiles in crude oils and refining cuts. For this reason a first part of the process preferably concerns itself with a screening of target substrates to detect a minimal required presence of such compounds.

The biocracking of normal and iso-paraffins is conducted by a novel process of Repetitive Alternating Carboxylation-Decarboxylation Cycle (RACDC). This process is a time and redox-dependent methodology based on a systematic bio-inoculation with co-metabolic and symbiotic microorganisms on qualified oil-base substrates. The envisioned preferred range of application coverage in terms of thermodynamic conditions for the oil/water system are as follows: temperatures ranging from about 40 degrees F. to about 300 degrees F and pressures ranging from about 1 to about 600 atm.

The carboxylation-decarboxylation cycle as illustrated in FIGS. 1, 2 and 3 is generally comprised of hemicycle A and hemicycle B. The following features generally and preferably characterize the hemicycles:

Hemicycle A, more particularly indicated by FIGS. 1 and 2:

- Carboxilative Microbial System characteristics: oxidant biota. EOR#1D, 2 Dry, 5PW, and the like (products that initiate carboxylic acid)
- Carboxilative Mechanisms: terminal oxidation-beta oxidation
- Carboxilative Bio-catalyzers characteristics: NAD/NADH, FAD/FADH, CoA
- Carboxilative complementary nutrients characteristics: TSA and other general media that cause the bacteria grow.

Hemicycle B, FIGS. 1 and 3:

- Decarboxilative Microbial System characteristics: denitrifying biota. EOR#1D, 2 Dry, SC, New #1, New#2, Syntrophic Archaeas System, specific encapsulated anaerobes, stimulants for natural anaerobes.
- Decarboxilative Mechanisms: Reductive-decarboxylation/Mild Thermal decarboxylation (Mild= 40 to 300 degrees F.)
- Decarboxilative bio-catalyzers characteristics: molybdenum element (metallic element forming part of some molecular structure enzymes). Nickel, Cobaltum elements (metallic elements forming part of some molecular structure enzymes)
- Decarboxilative complementary nutrients characteristics: nitrate/nitrite salts.

In regard to commercial significance, calculations indicate that a time averaged reduction of 15% +/−2%, or even greater, of original density in target product as measured by ASTM D-1217 may be possible.

The steps of the preferred embodiments preferably also include the following initial steps:

- Screening of original n-alkanes and iso-alkanes content and compositional pattern in target substrates using geochemical procedures.
- Determining the context of occurrence of the target substrate in the target system (oil reservoir, pipeline, storage tank, and the like). This step determines the original biotic/ecological status, physical and chemical and thermodynamic conditions (pressure, temperature, REDOX potential, and the like.) and characteristics of the solid/liquid/gaseous phases in interaction with target substrate (ionic pattern, and the like). Specific instrumental methods like mass spectrometry, NMR and chromatographic analysis and studies are typical at this state.
- Biocracking optimization design, including a selection of microbes, catalysts, nutrients, and the timing and sequencing of events, to cost effectively achieve target objectives in terms of the compositional alteration of an original n-alkane and iso-alkane profile on substrate occurring in the specific environment context (unitary block processes and operations).

In design of applications, our treatments (batch size) are preferably designed in preferred embodiments based on "system volume" for both phases (water, oil) and some scalable volumetric procedure (from lab to field) involving ratios or factors of "active substances" (microorganism, enzymes, salts, etc.). It may be preferable to calculate the batch size for MEOR applications by knowing that 5% v/v of Sodium Nitrate was working well at lab scale and then multiplying this factor by the injector producer streamtube water volume in barrels to obtain the treatment in gallons (providing the right unit factor, scaling, efficiencies, and the like). The frequency between treatments could be obtaining from the time of fight of a fluid particle. It may be beneficial to know the yield factors for every microorganism (P. putida) in terms of consumed substrates (C, N, P, and the like), in other words, kg of dry biomass by kg of carbon as substrate, and an elemental chemical analysis (CxNyPzOn) of the generated biomass.

The term "system volume" as used herein means the volume of oil or oil/water emulsions being treated and which are known or suspected of having target molecules. The term "residence time" has its normal meaning, and means the time that the system volume, preferably including target molecules, is in contact with microbes, in either the aerobic or anaerobic hemicycle.

Several specific applications of the methodology are preferred. A first preferred application is subsurface applications (oriented to upstream sector of the crude oil production industry). The scope of the application includes: producer wells, injector wells, water injection plants, batteries, EOR in oil-bearing reservoirs, subsurface oil storage facilities, boil-off capturing facilities, crude gas conditioning plants.

Preferred Steps Specific to Subsurface Applications

1. Pre-inoculation steps

Determination of an adaptive co-metabolic and symbiotic bio-products system to achieve hemicycle A (carboxylation/oxidative stage)

Determination of an adaptive co-metabolic and symbiotic bio-products system to achieve hemicycle B (decarboxylation/reductive stage)

Determination of sequence and timing of events in terms of bio-products inoculation to accomplish the Repetitive Alternating Carboxylation-Decarboxylation cycle (RACDC).

2. Hemicycle A step (FIGS. 1 and 2). Starting with the original status of the target substrate, initiate cycle by inoculating with the aerobic/facultative part of bio-products. Preferably include pseudomonads/denitrifying blend of microorganisms, nitrate/nitrite molybdenum salts and bio-catalyzers. Controllable parameters include: treatment size (expressed in volumetric units [gallons, liters, and the like] of water-base microbial concentrates having a minimal colony forming unit (CFU): $10^7$ units per ml, in a range of 10 to 10000 ppm of microbial concentrates on relevant system total fluid volume in discontinuous bioreactors, or 1 to 1000 ppm or microbial concentrates on relevant system total fluid input and/or output flow rate in continues bioreactors), microorganism type and participation (blend structure of aerobic/facultative microorganism), and viable cell density (minimal CFU: $10^7$ units per ml), contact time (4 to 72 hours), surfactant/co-surfactant additives (0.1 to 2 of CMC (Critical Mycellar Concentration)) of surfactant system, inhibitors (10 to 1000 ppm), dose of salts (from about 10 to 100 ppm), bio-catalyzers (from 1 to 100 ppm) batch size, microorganism participation (blend structure), resident time, surfactant/co-surfactant additives, inhibitors.

3. Intermediate. Preferably follow hemicycle A step with an inhibitory intermediate step to change from an aerobic/facultative environment to a progressively anaerobic one (low REDOX potential). This may be accomplished by depleting $0_2$ partial pressure and simultaneously by reducing nitrate/nitrite salts. Controllable parameters include treatment size (expressed in volumetric units [gallons, liters, and the like] of water-base microbial concentrates having a minimal CFU: $10^7$ units per ml, in a range of 10 to 10000 ppm of microbial concentrates based on relevant system total fluid volume in discontinuous bioreactors or 1 to 1000 ppm of microbial concentrates based on relevant system total fluid volume in discontinuosu bioreactors, or 1 to 1000 ppm of microbial concentrates on relevant system total fluid input and/or output flow rate in continuous bioreactors). Denitrifying microorganism participation (blend structure) and viable cell density (minimal CFU: $10^7$ units per ml), residence time (4 to 72 hours) surfactant/co-surfactant system, inhibitors (sodium bisulphite catalyzed with Cobaltum, 10 to 1000 ppm), dose of salts (between 10 to 100 ppm), dose of molybdenum salts (between 10 to 100 ppm), and bio-catalyzers (1 to 100 ppm).

4. Hemicycle B step (FIGS. 1 and 3). Following a carboxylated status of the target substrate, inoculate (and/or stimulate an indigenous Syntrophic system of Archaeas and Syntrophomonas) with syntrophic anaerobic (low REDOX potential) part of capsulated bio-products. Nickel/Cobaltum salts are preferred additives to support enzyme synthesis. Controllable parameters include treatment size (expressed in volumetric units [gallons, liters, and the like] of water-base microbial concentrates having a minimal CFU: $10^7$ units per ml, in a range of 10 to 10000 ppm of microbial concentrates based on relevant system total fluid volume in discontinuous bioreactors or 1 to 1000 ppm of microbial concentrates on relevant system total fluid input and/or output flow rate in continuous bioreactors), microorganism participation (Archaeas and Syntrophomonas blend structure) and viable cell density (minimal CFU: $10^7$ units per ml), contact time (5 to 60 days), surfactant/co-surfactant additives (0.1 to 2 of CMC (Critical Mycellar Concentration)) of surfactant/co-surfactant system, inhibitors (sodium bisulphite catalyzed with Cobaltum, 10 to 1000 ppm), dose of nickel salts (between 10 to 100 ppm), and bio-catalyzers (1 to 100 ppm).

5. Monitor. Monitoring performance by preferably measuring output variables in order to conduct "N" repetitive and alternative cycles of some or all of above steps.

Further preferred steps include:

simulations and low-scale tests pilot scale tests up-scaling procedures and process engineering setup.

A second preferred application is surface applications (oriented to upstream, transportation and downstream sectors). The scope of surface application include: storage tanks, refineries, oil/w/o emulsion transportation pipelines, petrochemical plants.

Preferred Steps Specific to Surface Applications

1. Pre-Inoculation Steps

Determination and optimization of an adaptive co-metabolic and symbiotic bio-products system to achieve hemicycle A (carboxylation/oxidative stage)

determination and optimization of an adaptive co-metabolic and symbiotic bio-products system to achieve hemicycle B (decarboxylation/reductive stage).

determination of sequence and timing of events in terms of bio-products inoculation to accomplish the Repetitive Alternating Carboxylation-decarboxylation Cycle (RACDC).

2. Hemicycle A Step (FIGS. 1 and 2). Starting with an original status of a target substrate, initiate cycle by inoculating the aerobic/facultative part of the bio-products. Preferably include pseudomonads/denitrifying blend of microorganism, nitrate/nitrite/molybdenum salts and bio-catalyzers. Controllable parameters include treatment size (expressed in volumetric units (gallons, liters, and the like) of water-base microbial concentrates having a minimal CFU: $10^7$ units per ml, in a range of 10 to 10000 ppm. of microbial concentrates based on relevant system total fluid volume in discontinuous bioreactors or 1 to 1000 ppm of microbial concentrates on relevant system total fluid input and/or output flow rate in continuous bioreactors), microorganism type and participation (blend structure of aerobic/facultative microorganism) and viable cell density (minimal CFU: $10^7$ units per ml), contact time (4 to 72 hours), surfactant/co-surfactant additives (0.1 to 2 of CMC (Critical Mycellar Concentration)) of surfactant system), inhibitors (10 to 1000 ppm.), dose of salts (between 10 to 100 ppm), bio-catalyzers (1 to 100 ppm.).

3. Intermediate. Preferably follow hemicycle A step with an inhibitory intermediate stage to change from aerobic/facultative environment to a progressively anaerobic one (low REDOX potential). This is preferably accomplished by depleting oxygen partial pressure by addition of oxygen scavengers and, preferably simultaneously, by reducing nitrate/nitrite salts. Controllable parameters include treatment size (expressed in volumetric units (gallons, liters, and the like) of water-base microbial concentrates having a minimal CFU: $10^7$ units per ml, in a range of 10 to 10,000 ppm of microbial concentrates based on relevant system total fluid volume in discontinuous bioreactors, or 1 to 1000 ppm of microbial concentrates on relevant system total fluid input and/or output flow rate in continuous bioreactors), denitrifying microorganism participation (blend structure), viable cell density (minimal CFU: $10^7$ units per ml), residence time (4 to 72 hours), surfactant/co-surfactant additives (0.1 to 2 of CMC of surfactant/co-surfactant system), inhibitors (Sodium bisulphite catalyzed with Cobaltum, 10 to 1000 ppm.), dose of salts (between 10 to 100 ppm), dose of molybdenum salts (between 10 to 100 ppm), and bio-catalyzers (1 to 100 ppm.), 4. Hemicycle B (FIG. 2): Following the carboxylated status of target substrate by inoculating (or by stimulating the indigenous syntrophic system of Archaeas and Syntrophomonas) with the syntrophic anaerobic (low REDOX potential) part of capsulated bio-products. Nickel/cobaltum salts are preferably added to support enzyme synthesis. Controllable parameters include treatment size (expressed in volumetric units (gallons, liters, and the like) of water-base microbial concentrates, preferably in capsulated form, having a minimal CFU: $10^7$ units per ml, in a range of 10 to 10000 ppm of microbial concentrates based on relevant system total fluid volume in discontinuous bioreactors, or 1 to 1000 ppm of microbial concentrates on relevant system total fluid input and/or output flow rate in continuous bioreactors), microorganism participation (Archaeas and Syntrophomonas blend structure), viable cell density (minimal CFU: $10^7$ units per ml), contact time (5 to 60 days), surfactant/co-surfactant additives (0.1 to 2 of CMC) of surfactant/co-surfactant system, inhibitors (Sodium bisulphite catalyzed with Cobaltum, 10 to 1000 ppm), dose of nickel salts (between 10 to 100 ppm), and bio-catalyzers (1 to 100 ppm.).

5. Monitoring. Monitor performance in order to conduct "N" repetitive and alternating cycling of some or all of above steps, having a frequency range between 5 days to 60 days, by measuring output variables related with system performance (preferably by serial chromatographic analysis). Repetitive Alternating Carboxylation-Decarboxylation Cycle (RACDC) may be conducted during the economic life of the application in course.

Further Preferred Steps:

simulation and low-scale tests pilot scale tests up-scaling procedures and process engineering setup.

Preferred procedures for "Repetitive Alternating Carboxylation-Decarboxylation Cycling" process are discussed below in conjunction with the following steps. Each step is independent but inclusive to the process as a whole for convenience. Various measurements may be required between steps in order to determine appropriate timing between each step.

Carboxylation—Hemicycle "A"

Step 1:

Aerobic and facultative microorganisms including a nutrient base are introduced into the system volume. This step is to initiate "terminal oxidation" of hemicycle A. This step is actually introducing oxygen into the system environment due to dissolved oxygen present in the aqueous phase of the treatment. The volume and design of this treatment step may be unchanged to what essentially has been essentially performed for MEOR.

Step 2:

Nitrate, nitrite, molybdenum salt and/or other bio-catalyzers are preferably added to the system volume in order to trigger or enhance "beta oxidation" of hemicycle A. The addition of these compounds is prefered, but not required, in Step 1 above. The compounds may or may not exist in MEOR product recipes.

Decarboxylation—Hemicycle B:

Step 3:

If necessary, oxygen scavengers will be used to speed the depletion of oxygen in the system volume. This step may or may not be implemented depending on particular conditions of the system environment.

Step 4:

Introduction of capsulated anaerobic microorganisms and/or possibly the stimulation of indigenous anaerobic microorganisms already present in the system volume. In all likelihood indigenous anaerobic microorganisms would only be present in subsurface applications. Surface (i.e. surface bioreactors) applications of the present invention will likely require additions of anaerobic microorganisms in order to complete the cycle.

Step 5:

One or more nickel coenzymes known under the trade designations F420 and F430, and preferably vitamins are added to the system environment in order to trigger "bio/thermal decarboxylation" of hemicycle "B." This step may or may not be included as part of Step 4.

Step 6:

Return to Step 1.

In preferred embodiments in a subsurface application, Step 1 and Step 2 would be performed simultaneously. The well would then preferably be shut in for fluid production for one to three days. Production would then preferably commence for approximately a week. During this production period the degree of carboxylation would be measured. After the week, assuming adequate carboxylation and no need for oxygen scavengers, step (4) and preferably step (5) would be performed. The well would then be shut in for a period of hours. Subsequently the well would be produced for one to three weeks. Then steps 1 and 2 would be repeated.

Prior to beginning the processes of the invention, and preferably during the process testing, it is preferred to determine that the timing of the process is proceeding as originally designed. Testing is also preferred to determine the benefit and need for oxygen scavengers (step (3)). Testing may also alert the operator to alter the blend of microbes and/or nutrients and/or enzymes and catalysts being utilized.

As illustrated in FIG. 1, the second hemicycle, the decarboxylation cycle, may take Path A or Path B. Path A is a strict biocatalytic reduction/dehydration. Path B involves a thermal/biocatalytic reduction by removing one further carbon from the chain. To the extent Path A is followed one carboxylation-decarboxylation cycle should remove two carbons from the carboxylic acid chain. The second hemicycle may or may not remove a further carbon from the chain.

EXAMPLE

The following calculations illustrate the technical-economical feasibility of n-alkanes compositional pattern bio-alteration in paraffinic crude oils to produce novel and effective volumetric expansion.

According with the nature of density vs. carbon length number relationship for alkanes, it is theoretically feasible to use biotechnological procedures to alter selectively the original profile of these hydrocarbons in a mix of these compounds in order to convert the heavy molecular weight portions to lighter ones. One important consequence of such alteration is that as original density decreases it will produce an equivalent volume expansion in the mix.

$$d_i := 0.8573 = \frac{1.3100}{Nc_i + 0.82}$$

Where $d_i$ is the relative-to-water density at standard condition (dimensionless) and $Nc_i$ is carbon length number.

Figure 4:
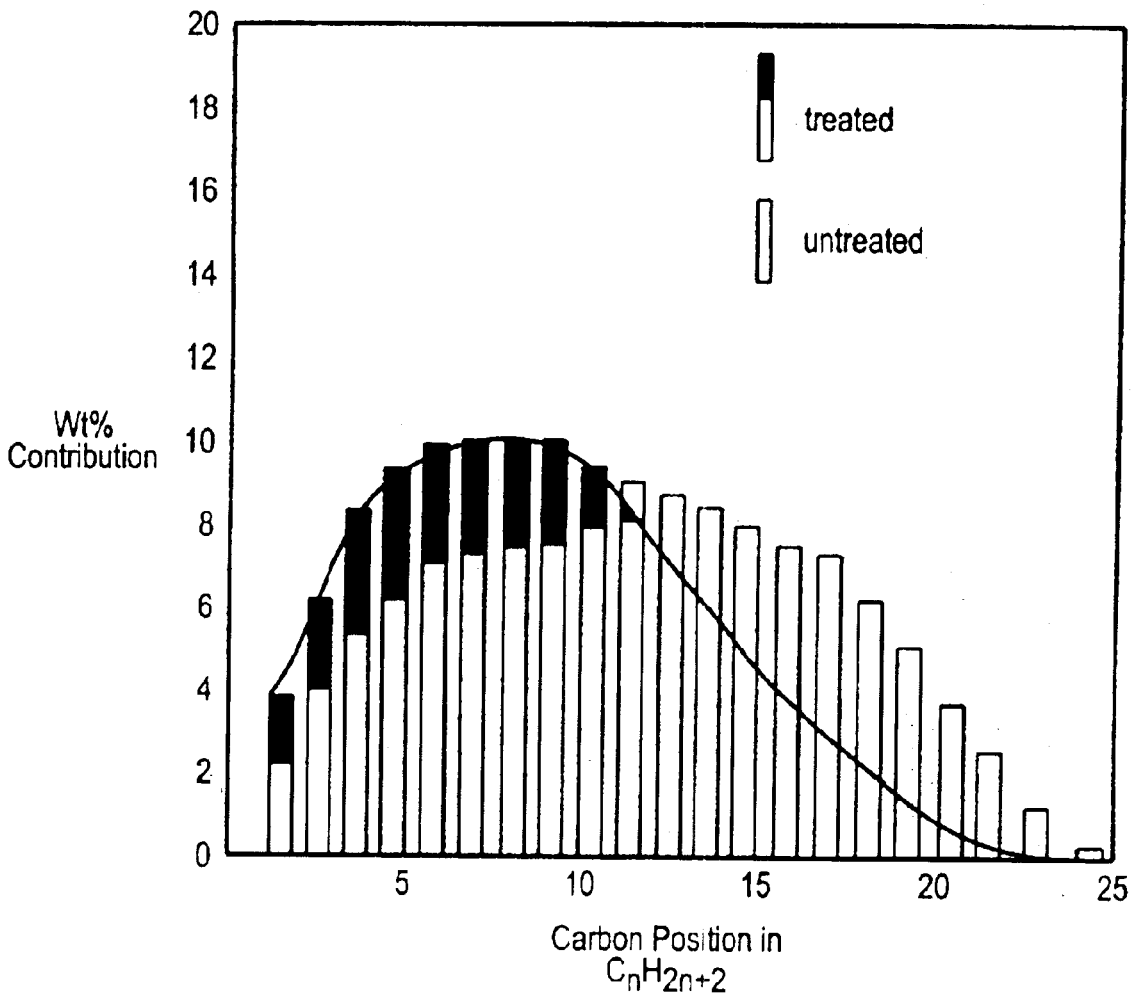
FIG. 4 illustrates postulated original and bio-converted n-alkane profiles (trace envelope between $C_2$ and $C_{23}$)

If we postulate an original and bio-converted n-alkanes profile (trace envelope between $C_2$ and $C_{23}$) as shown in FIG. 4, the density changes before and after biocracking process may be calculated, as is illustrated in FIG. 5. The corresponding volumetric expansion, assuming no significant mass loss and constant temperature, will be as calculated in FIG. 6.

The result for the sample size under consideration is a depletion in 4.32% in density and an expansion in volume of 4.52%.

List of Symbols and Nomenclature for FIGS. 4, 5 and 6

$d_i$ is the relative-to-water density at standard conditions (dimensionless)

$Nc_i$ is carbon length number (dimensionless).

mi: is the mass participation per component ith in the BIO-CRACKED sample

[grams]

mmi: is the mass participation per component ith in the CONTROL sample [grams]

r sc: relative-to-water mass-averaged density at standard condition for BIO-CRACKED sample (dimensionless).

r scm: relative-to-water mass-averaged density at standard condition for CONTROL sample (dimensionless).

Dr sc: Density variation due to compositional changes (dimensionless)

Vsc: Volume of BIO-CRACKED sample [milliliters]

Vscm: Volume of CONTROL sample [milliliters]

D V%: Volume variation of BIO-CRACKED sample referred to CONTROL sample[%].

Practical results in crude oils having always less than 100% of saturates in their composition, will be affected by NSO participation (assumed unchanged during saturates biocracking) and will be falling below the mentioned theoretical result. Loss of mass by microbial consumption will also reduce the expected volume expansion/density reduction effect. This is demonstrated in the calculations of FIG. 7. The result for the oil considered (70% n-alkanes, 3% NSO compounds) shifts our first result from 4.52% to 3.46% in terms of volume expansion. Mass conservation hypothesis remains active.

Field evidence of density reduction of this magnitude (wellhead samples) was obtained during subsurface prior art MEOR applications with several paraffinic crude oils (Altamont Blue Bell [USA], Piedras Coloradas [Argentina], Konys [KAS]).

List of Symbols and Nomenclature for FIG. 7

W%ALCANES: Normal and iso-alkanes (treatable portion) in postulated oil (dimensionless)

W%RINGs: Untreatable ring-compound portion of postulated oil (dimensionless)

r sc_BIOMIX: relative-to-water mass-averaged density at standard condition for BIO-CRACKED oil sample (dimensionless).

r sc_CONTROLMIX: relative-to-water mass-averaged density at standard conditions for CONTROL oil sample (dimensionless).

D V%: Volume variation of BIOMIX oil sample referred to CONTROL oil sample [%]

Although the above description of preferred procesess of the invention are representative of the invention, they are by no means intended to limit the scope of the appended claims.

What is claimed is:

1. A method for treating a composition comprising one or more alkanes to enhance volume of the composition, the method comprising the steps of:

(a) introducing into the composition one or more microorganisms selected from the group consisting of aerobic microorganisms, facultative microorganisms, and combinations thereof, and maintaining reaction conditions between the microorganisms and composition effective to carboxylate a substantial amount of the alkanes via terminal and beta oxidation and thus forming an intermediate composition comprising terminal carboxylic acids;

(b) introducing one or more anaerobic microorganisms into the intermediate composition; creating and maintaining anaerobic reaction conditions between the anaerobic microorganisms and intermediate composition effective to decarboxylate a substantial amount of the terminal carboxylic acids and thus forming a second composition; and (c) sequentially repeating steps (a) and (b) at least once such that the treated composition is of enhanced volume.

2. The method of claim 1 wherein step (a) is performed at least three days prior to step (b).

3. The method of claim 2 that includes shutting in a well at least one day and then producing the well at least three days between step (a) and step (b).

4. The method of claim 3 that includes shutting in the well at least hours and producing the well for over a wee subsequent to step (b) and prior to repeating step (a).

5. The method of claim 1 wherein step (b) includes introducing capsulated anaerobic microorganisms.

6. The method of claim 1 that includes introducing a nutrient base into the composition.

7. The method of claim 1 that includes introducing a nutrient base into the composition in conjunction with step (a).

8. The method of claim 1 that includes adding at least one of nitrate, nitrite and molybdenum salt into the composition.

9. The method of claim 8 that includes adding at least one of nitrate, nitrite and molybdenum salt in a step separate to step (a).

10. The method of claim 1 that includes adding a biocatalyst to the composition.

11. The method of claim 10 that includes adding a biocatalyst in a step separate to step (a).

12. The method of claim 1 that includes adding an oxygen scavenger to the composition.

13. The method of claim 12 wherein adding said oxygen scavenger occurs prior to step (b).

14. The method of claim 12 wherein adding said oxygen scavenger occurs after step (a).

15. The method of claim 1 that includes introducing both anaerobic microorganisms to the intermediate composition and stimulating indigenous anaerobic microorganisms.

16. The method of claim 1 that includes introducing both aerobic and facultative microorganisms into the composition.

17. The method of claim 1 that includes adding a coenzyme selected from the group consisting of F420 and F 430.

18. The method of claim 17 that includes adding both coenzymes F 420 and F 430.

19. The method of claim 17 that includes adding at least one of coenzymes F 420 and F 430 in conjunction with step (b).

20. A method for treating a crude oil comprising alkanes to enhance volume of the crude oil, the method comprising the steps of:

(a) introducing into the crude oil one or more microorganisms selected from the group consisting of aerobic microorganisms, facultative microorganisms, and combinations thereof, and maintaining reaction conditions between the microorganisms and composition effective to carboxylate a substantial amount of the alkanes via terminal and beta oxidation and thus forming an intermediate crude oil comprising terminal carboxylic acids;

(b) introducing one or more anaerobic microorganisms into the intermediate crude oil; creating and maintaining anaerobic reaction conditions between the anaerobic microorganisms and intermediate composition effective to decarboxylate a substantial amount of the terminal carboxylic acids and thus forming a second crude oil; and (c) sequentially repeating steps (a) and (b) at least once such that the treated crude oil is of enhanced volume.

21. The method of claim 20 that includes achieving a volume increase of at least 10%.

22. The method of claim 20 that includes achieving a volume increase of at least 15%.

23. The method of claim 20 wherein step (a) is performed at least three days prior to step (b).

24. The method of claim 23 that includes shutting in a well at least one day and then producing the well at least three days between step (a) and step (b).

25. The method of claim 24 that includes shutting in the well at least hours and producing the well for over a week subsequent to step (b) and prior to repeating step (a).

26. The method of claim 20 wherein step (b) includes introducing capsulated anaerobic microorganisms.

27. The method of claim 20 that includes in a nutrient base into the crude oil.

28. The method of claim 20 that includes introducing a nutrient base into the crude oil in conjunction with step (a).

29. The method of claim 20 that includes adding at least one of nitrate, nitrite and molybdenum salt into the crude oil.

30. The method of claim 20 that includes adding a biocatalyst to the crude oil.

31. The method of claim 30 that includes adding at least one of nitrate, nitrite and molybdenum salt in a step separate to step (a).

32. The method of claim 31 that includes adding a biocatalyst in a step separate to step (a).

33. The method of claim 20 that includes adding an oxygen scavenger to the crude oil.

34. The method of claim 33 wherein adding said oxygen scavenger occurs prior to step (b).

35. The method of claim 33 wherein adding said oxygen scavenger occurs after step (a).

36. The method of claim 20 that includes introducing both anaerobic microorganisms to the intermediate crude oil and stimulating indigenous anaerobic microorganisms.

37. The method of claim 20 that includes introducing both aerobic and facultative microorganisms into the crude oil.

38. The method of claim 20 that includes adding a coenzyme selected from the group consisting of F420 and F 430.

39. The method of claim 38 that includes adding both coenzymes F 420 and F 430.

40. The method of claim 38 that includes adding at least one of coenzymes F 420 and F 430 in conjunction with step (b).

* * * * *